US007785163B2

(12) United States Patent
Spencer et al.

(10) Patent No.: US 7,785,163 B2
(45) Date of Patent: Aug. 31, 2010

(54) WAVE ENERGY BUOY

(75) Inventors: Steven M. Spencer, La Center, WA (US); Randall R. Thom, Portland, OR (US)

(73) Assignee: Plasti-Fab Inc., Tualatin, OR (US)

( * ) Notice: Subject to any disclaimer, the term of this patent is extended or adjusted under 35 U.S.C. 154(b) by 0 days.

(21) Appl. No.: 12/192,723

(22) Filed: Aug. 15, 2008

(65) Prior Publication Data

US 2010/0041289 A1 Feb. 18, 2010

(51) Int. Cl.
*B63B 22/00* (2006.01)

(52) U.S. Cl. ..... 441/1; 114/294; 290/53

(58) Field of Classification Search ..... 441/1, 441/16; 290/42, 53, 43, 54; 114/293, 294; 60/495

See application file for complete search history.

(56) References Cited

U.S. PATENT DOCUMENTS

| | | | | |
|---|---|---|---|---|
| 3,546,473 | A * | 12/1970 | Rich | 290/42 |
| 4,754,157 | A * | 6/1988 | Windle | 290/53 |
| 5,651,427 | A * | 7/1997 | Kulak et al. | 187/330 |
| 7,140,180 | B2 * | 11/2006 | Gerber et al. | 60/496 |
| 7,310,944 | B2 * | 12/2007 | Sabol et al. | 60/495 |
| 7,476,137 | B2 * | 1/2009 | Stewart et al. | 441/1 |
| 2002/0155767 | A1 * | 10/2002 | Sung | 441/16 |

* cited by examiner

*Primary Examiner*—Lars A Olson
(74) *Attorney, Agent, or Firm*—Chernoff, Vilhauer, McClung & Stenzel

(57) ABSTRACT

A wave energy buoy includes a spar that may be anchored to the sea bed and a float fitted to the spar for movement axially of the spar. The spar includes a spar tube and the float includes a generally annular shell defining an opening through which the spar tube extends. The spar tube and the float shell are made of composite material.

17 Claims, 3 Drawing Sheets

WAVE ENERGY BUOY

BACKGROUND OF THE INVENTION

The subject matter disclosed in this application relates to a wave energy buoy.

Recent years have seen an increasing level of interest in methods of generating electrical energy without need for a continuous supply of fossil fuel. One of the methods currently of interest involves recovering energy from water waves using a wave energy buoy.

Referring to FIG. 1 of the drawings, one form of wave energy buoy comprises an elongate steel spar that carries a generally annular steel float. The spar is buoyant in sea water and is anchored to the sea bed at a height such that it penetrates the free surface of the water and, in calm conditions, extends substantially vertically upward.

The float is fitted about the spar and is supported relative to the spar for movement lengthwise of the spar by wheels (not shown) that are attached to the float and engage the exterior surface of the spar for guiding movement of the float. The spar and the float are provided with respective components of a linear generator. Thus, an armature is mounted internally of the spar and the float carries a permanent magnet assembly. As waves pass the spar, and the free surface of the water rises and falls relative to the spar, the float reciprocates lengthwise of the spar and electromagnetic interaction between the armature and the magnetic field of the permanent magnets generates an electromotive force that drives an electrical current in the armature. The armature is connected through cables (not shown) extending through the bottom end of the spar to collector cables leading to a shore-based distribution station.

The conventional wave energy buoy described above is subject to a number of disadvantages. First, the steel spar and float must be protected from corrosion by sea water, generally by painting. Any damage to the paint, for example by impact with flotsam, must be repaired promptly, which necessitates frequent inspection and maintenance. Painted steel structures are subject to build-up of deposits of aquatic organisms, which must be periodically removed to ensure that they do not interfere with movement of the float. For example, should a deposit cause one of the wheels supporting the float relative to the spar to jam or bind, movement of the float may result in the wheel scraping or gouging the surface of the spar. In addition, any sticking of the float relative to the spar reduces the electrical efficiency of the wave energy buoy.

Various forms of composite materials (including fiber reinforced plastic, or FRP) have been used for several years for manufacture of a wide range of industrial products. Techniques have been developed for manufacture of products of fairly complex shape using composite material. One method of forming an article of FRP involves winding strands of fiberglass around a core, which may be a collapsible mandrel, impregnating the fiberglass winding with resin, and curing the resin. Alternatively, an article of FRP may be fabricated by placing mats of glass fiber material against a mold surface, impregnating the glass fiber material with resin, and curing the resin. The curing may be effected either by baking at an elevated temperature of by catalysis at a lower temperature. The surface of the composite material may then be machined to a desired surface finish.

In certain applications of composite materials a silica carbide additive is included in the resin. Silica carbide is a hard material that renders the composite material resistant to damage by abrasion. For example, scrubbers used for removing sulphur dioxide from a coal/water slurry may include components made of composite material including silica carbide.

SUMMARY OF THE INVENTION

In accordance with the subject matter disclosed in this application there is provided a wave energy buoy comprising a spar including an elongate tube and a means for anchoring the tube to the sea bed, and a float fitted to the spar for movement axially of the spar, the float including a generally annular shell defining an opening through which the spar tube extends, and wherein the spar tube and the float shell are made of composite material.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
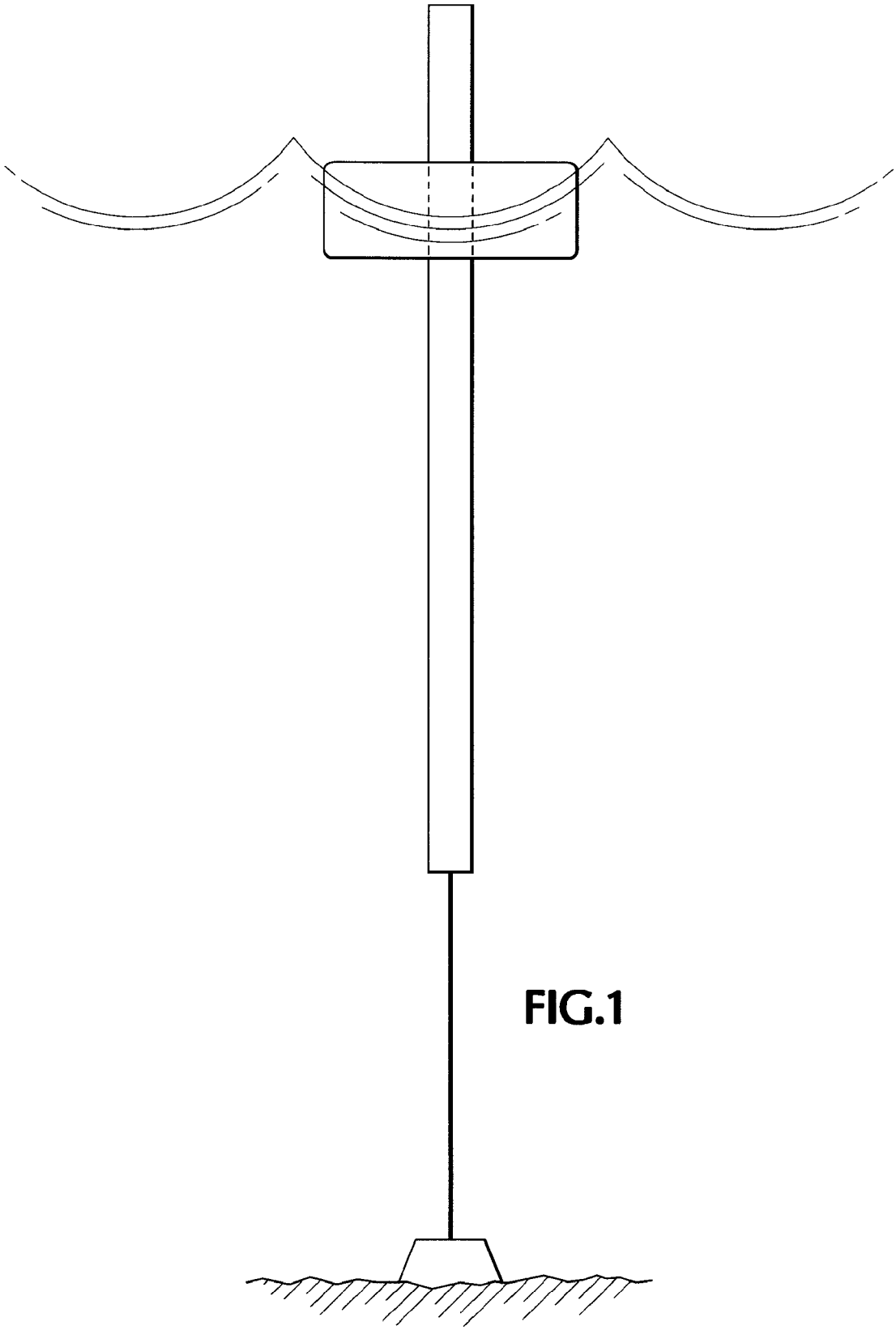
FIG. 1 is a schematic illustration of a conventional wave recovery buoy.
Figure 2:
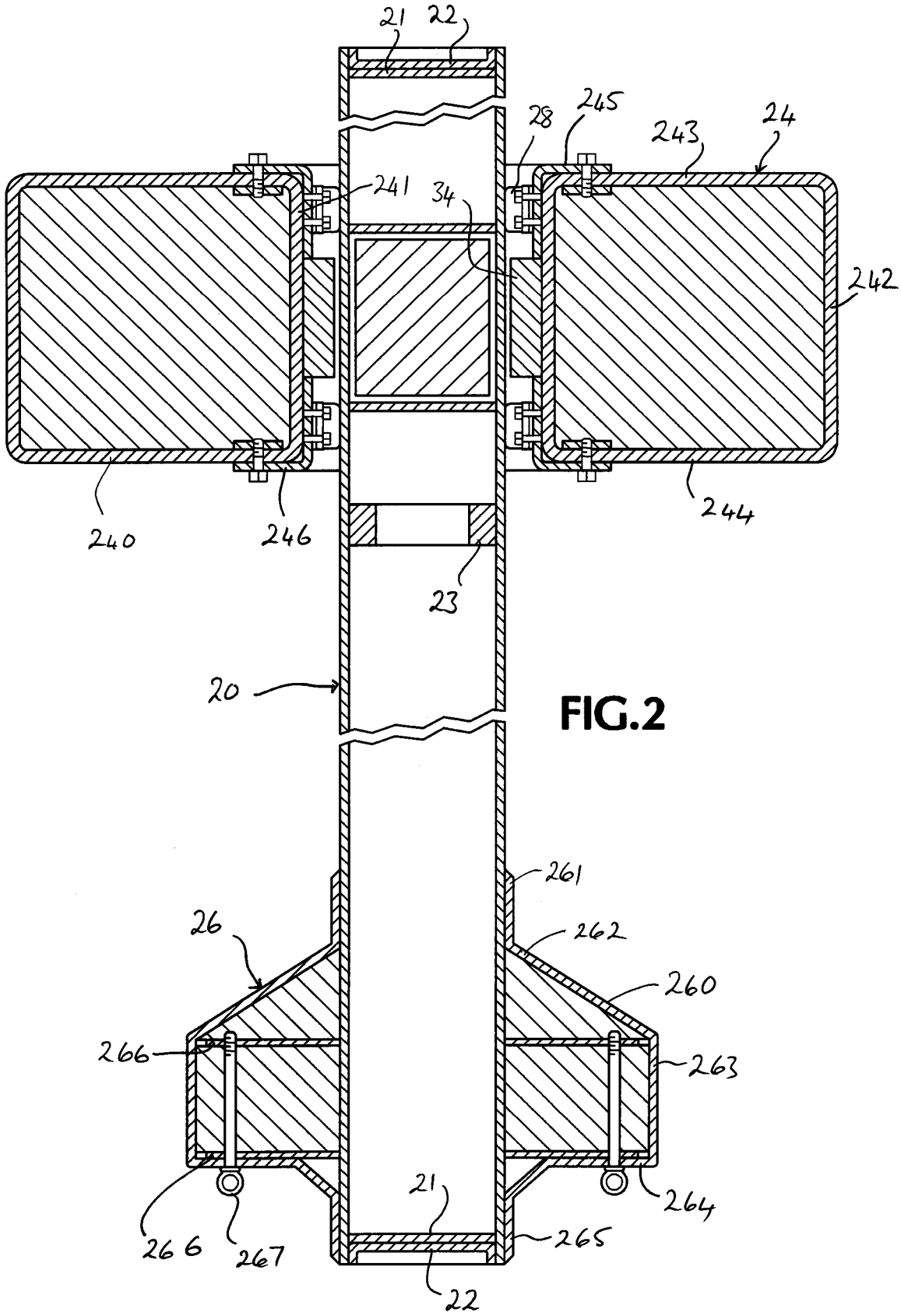
FIG. 2 is a partial sectional view of a wave energy buoy embodying the disclosed subject matter.
Figure 3:
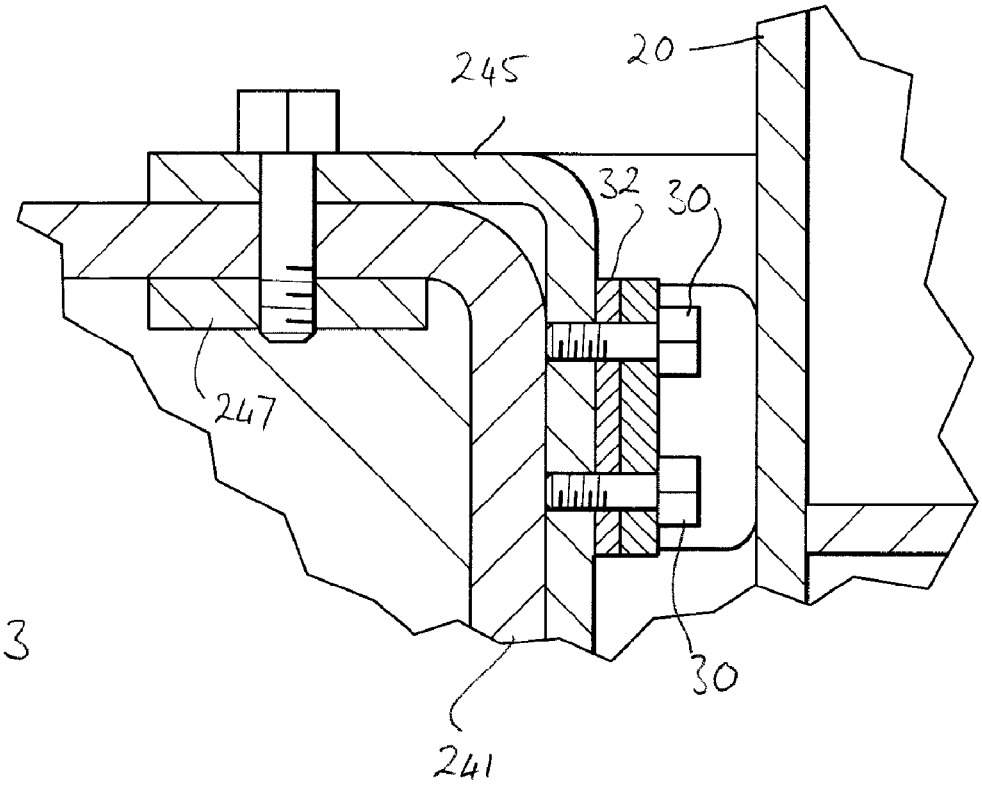
FIG. 3 is an enlarged detail view of a portion of the float.
Figure 4:
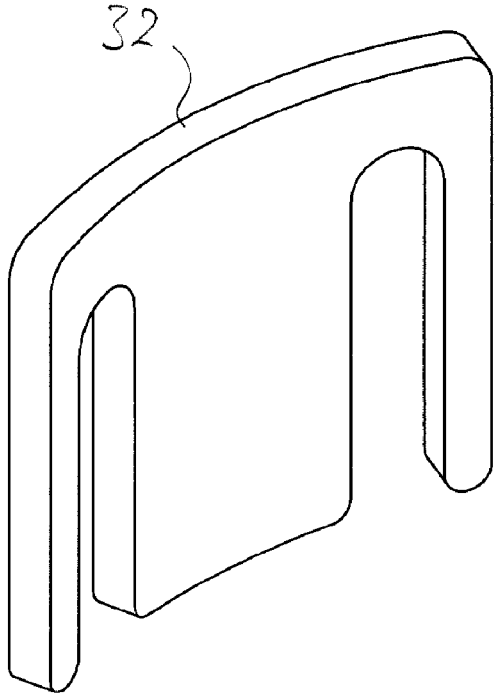
FIG. 4 illustrates a shim for positioning the float relative to the spar.

The wave energy buoy shown in FIGS. 2-4 comprises a spar 20, a float 24 and a bulb assembly 26. The spar comprises a tube made of composite material. The tube may be manufactured by winding strands of fiberglass around a suitable mandrel, impregnating the fiberglass winding with resin, such as a vinyl ester resin containing a suitable catalyst, allowing the resin to cure, and removing the mandrel. The exterior of the resulting tube is machined, at least over an upper region thereof, to provide a suitable surface finish, e.g. having an ASTM smoothness of 150.

Near its upper end, the spar tube contains the armature for a linear generator. The armature is secured in position inside the spar tube by adhesive.

The spar tube is provided at each end with a composite closure plate 21. The closure plate 21 is made by placing a mat of fiberglass against a suitable molding surface and impregnating the mat with resin containing a catalyst and allowing the resin to cure. The closure plate is trimmed if necessary, placed inside the bottom end of the spar tube and secured to the spar tube by encapsulation 22, i.e. by placing a mat of fiberglass over the bottom closure plate and adjoining areas of the interior surface of the spar tube, impregnating the fiberglass mat with resin containing a catalyst, and allowing the resin to cure. In this manner, the bottom closure plate is securely attached to the spar.

The composite material employed in manufacture of the spar is more dense than water. Accordingly, in order to prevent the spar from sinking should it become waterlogged, internal foam buoyancy rings 23 may be provided inside the spar tube or the interior space of the spar tube may be at least partially filled with a closed cell foam.

The bulb assembly 26 comprises an outer shell 260 having five main sections. The top and bottom sections 261, 265 of the shell are cylindrical. Below the top section 261 is a section 262 that flares conically downward, a cylindrical section 263, and a generally radial section 264 connecting the cylindrical section 263 to the bottom section 265.

The shell 260 accommodates an attachment structure for attaching the spar to anchor cables. The attachment structure comprises two annular steel plates 266 disposed perpendicular to the central axis of the spar tube and spaced apart lengthwise of the spar tube. Each plate is formed with eight equiangularly spaced, internally threaded holes, and the plates are positioned so that each hole in the lower plate is axially aligned with a corresponding hole in the upper plate. Each pair of corresponding holes receives an externally threaded steel eye-bolt 267.

The shell 260 also contains blocks of closed cell foam supporting the attachment structure relative to the shell. The foam blocks may be provided in the form of annular plates, formed as necessary with holes to receive the eye-bolts 267.

The shell 260 is manufactured in similar fashion to the tube of the spar. The foam blocks and the attachment structure are assembled about a mandrel of external diameter substantially equal to that of the spar tube and the shell 260 is formed about the attachment structure by winding strands of fiberglass about the mandrel and the foam blocks. The fiberglass winding is impregnated with resin and the resin is allowed to cure. After the shell is formed, the mandrel is removed. The steel bolts are secured in position relative to the shell during the formation of the shell and the resin bonds firmly to the steel bolts.

The internal diameter of the top and bottom cylindrical sections 261, 265 is substantially equal to the external diameter of the spar tube, allowing the spar tube to be inserted axially through the shell, as shown in FIGS. 2 and 4.

The completed bulb assembly comprising the shell 260, anchor attachment structure and foam filling is installed on the lower end of the spar as an integral unit, by inserting the spar tube through the opening left in the assembly by removal of the mandrel. The shell is then attached to the spar tube by encapsulation. Thus, an overlay of fiberglass mat is placed over the top and bottom sections 261, 265 of the shell and adjoining areas of the spar tube and, as described above, the fiberglass mat is impregnated with resin containing a suitable catalyst and the resin is allowed to cure, resulting in the shell being securely attached to the spar tube.

The anchor attachment structure and the foam blocks transfer the tension in the anchor cables to the spar without any excessive localized stress.

The float 24 is generally annular in configuration and comprises a shell 240 made of composite material and having inner and outer cylindrical walls 241, 242 and top and bottom walls 243, 244. The interior of the shell is filled with closed cell foam and steel attachment devices are embedded in the wall of the shell at various locations for purposes that are described below. The shell is made by winding strands of glass fiber. Suitable techniques for manufacture of the shell have been developed for manufacture of various industrial products, such as insulating tanks, and are well known among those skilled in the art.

The shell is provided with top and bottom caps 245, 246. Each cap has a cylindrical portion that projects into the opening defined by the inner wall 241 of the shell and has an annular external flange that projects outwardly, over the top or bottom wall of the shell. The caps are secured to the shell by bolts passing through openings in the circular flanges and engaging top and bottom steel attachment plates 247 that are embedded in the top and bottom walls of the shell.

An upper set of twelve bumpers 28 is attached to the shell about the interior of the opening defined by the top cap 245 and are equiangularly distributed about the central axis of the annular shell. The bumpers are made of self-lubricating polymer material that does not absorb water, such as PTFE or a UHMW polymer material. Preferably, the bumpers are made of a UV resistant carbon filled polyolefin material sold under the description TIVAR 1000. Each bumper is attached to the top cap by four bolts arranged in a square and engaging the top cap. The four bolts are countersunk relative to the inner surface of the bumper to avoid contact between the bolts and the spar tube. Shims 32 may be interposed between the bumper and the top cap. The shims are made of composite material and have slots that allow them to be fitted over the bolts that attach the bumper to the top cap. By selecting shims of appropriate thickness, the inner surfaces of the bumpers can be positioned with sufficient precision on a circle of a desired radius that allows a small clearance between the bumpers and the spar, without need to machine the cylindrical portion of the top cap.

In similar fashion, a lower set of twelve bumpers is attached to the shell about the interior opening defined by the bottom cap 246.

The float also comprises an annular permanent magnet assembly 34 located between the top and bottom caps in the opening defined by the inner wall of the shell. The nature of the permanent magnet assembly depends on the design of the linear generator. The radial position of the inner surfaces of the bumpers is selected to provide proper positioning of the permanent magnet assembly relative to the spar tube.

In order to minimize friction between the bumpers and the spar, and maximize electrical efficiency of the generator, the outer surface of the spar tube may be machined, at least over the movement range of the float, to a smoothness of ASTM 150.

Use of composite material for fabrication of the wave energy buoy described with reference to FIGS. 2-5 is advantageous relative to the steel that is conventionally used for wave energy buoys because inspection and maintenance intervals are substantially longer. The self-lubricating bumpers riding against the exterior surface of the spar avoid the need for rollers and the disadvantages associated with use of rollers. The composite materials are not attractive to aquatic organisms and accordingly there is little likelihood of build up of deposits of organisms on the surfaces of the buoy. The bumpers are subject to wear but are readily replaceable during normal maintenance, or additional shims may be inserted to take up clearance generated by wear of the bumpers.

In a preferred embodiment of the invention, silica carbide is included in the resin that is applied over the outer layers of the fiberglass winding of the spar tube, at least over the range of movement of the float. This is advantageous because the silica carbide is extremely hard wearing and is therefore more long-lasting than composite material without silica carbide. Although cured vinyl ester resin incorporating silica carbide is hard, it is nevertheless machinable.

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

The invention claimed is:

1. A wave energy buoy, comprising:

a spar including an elongate tube comprising a cured resin matrix containing silica carbide and a means for anchoring the tube to the sea bed, and a float fitted to the spar for movement axially of the spar, the float including a generally annular shell defining an opening through which the spar tube extends and a self-lubricating bumper structure attached to the shell and projecting into the opening for guiding movement of the float relative to the spar.

2. A wave energy buoy according to claim 1, wherein the cured resin matrix comprises glass fiber and vinyl ester.

3. A wave energy buoy according to claim 1, comprising fibers embedded in the cured resin matrix.

4. A wave energy buoy according to claim 1, wherein the float comprises top and bottom caps attached to the annular shell and each comprising a cylindrical portion extending into the opening defined by the annular shell and an external flange extending over an end surface of the shell.

5. A wave energy buoy according to claim 1, wherein the means for anchoring the tube to the sea bed comprises a generally conical shell attached to the spar tube at a lower end thereof and containing a steel attachment structure and a foam filling for transferring force from the steel attachment structure to the spar tube.

6. A wave energy buoy according to claim 1, wherein the self-lubricating bumper structure comprises at least three self-lubricating bumpers spaced substantially equiangularly about the spar.

7. A wave energy buoy according to claim 1, wherein the annular shell has top and bottom ends and a substantially cylindrical interior surface extending between the top and bottom ends, and the self-lubricating bumper structure comprises an upper set of at least three self-lubricating bumpers attached to the shell adjacent the top end and projecting inward of the interior surface and a lower set of at least three self-lubricating bumpers attached to the shell adjacent the bottom end and projecting inward of the interior surface.

8. A wave energy buoy, comprising:

a spar including an elongate tube and a means for anchoring the tube to the sea bed, and a float fitted to the spar for movement axially of the spar, the float including a generally annular shell defining an opening through which the spar tube extends, and wherein the spar tube and the float shell are made of composite material, and the float comprises top and bottom caps attached to the annular shell and each comprising a cylindrical portion extending into the opening defined by the annular shell and an external flange extending over an end surface of the shell, and at least three self-lubricating bumpers attached to each cap and spaced substantially equiangularly about the spar for guiding movement of the float relative to the spar.

9. A wave energy buoy according to claim 8, wherein the composite material comprises glass fiber and vinyl ester.

10. A wave energy buoy according to claim 8, wherein the composite material comprises fibers embedded in a cured resin matrix.

11. A wave energy buoy according to claim 8, wherein composite material of the spar tube comprises fibers embedded in a cured resin matrix, and the resin contains silica carbide.

12. A wave energy buoy according to claim 8, wherein the means for anchoring the tube to the sea bed comprises a generally conical shell attached to the spar tube at a lower end thereof and containing a steel attachment structure and a foam filling for transferring force from the steel attachment structure to the spar tube.

13. A wave energy buoy, comprising:

a spar including an elongate tube and a means for anchoring the tube to the sea bed, and a float fitted to the spar for movement axially of the spar, the float including a generally annular shell defining an opening through which the spar tube extends, and wherein the spar tube and the float shell are made of composite material and the means for anchoring the tube to the sea bed comprises a generally conical shell attached to the spar tube at a lower end thereof and containing a steel attachment structure and a foam filling for transferring force from the steel attachment structure to the spar tube.

14. A wave energy buoy according to claim 13, wherein the composite material comprises glass fiber and vinyl ester.

15. A wave energy buoy according to claim 13, wherein the composite material comprises fibers embedded in a cured resin matrix.

16. A wave energy buoy according to claim 13, wherein composite material of the spar tube comprises fibers embedded in a cured resin matrix, and the resin contains silica carbide.

17. A wave energy buoy according to claim 13, wherein the annular shell has top and bottom ends and a substantially cylindrical interior surface extending between the top and bottom ends, and the float further comprises an upper set of at least three self-lubricating bumpers attached to the shell adjacent the top end and projecting inward of the interior surface and a lower set of at least three self-lubricating bumpers attached to the shell adjacent the bottom end and projecting inward of the interior surface.

* * * * *